US008433210B2

(12) United States Patent
Nishida

(10) Patent No.: US 8,433,210 B2
(45) Date of Patent: Apr. 30, 2013

(54) IMAGE FORMING APPARATUS, STORAGE MEDIUM AND IMAGE FORMING METHOD

(75) Inventor: Satoshi Nishida, Saitama (JP)

(73) Assignee: Konica Minolta Business Technologies, Inc. (JP)

( * ) Notice: Subject to any disclaimer, the term of this patent is extended or adjusted under 35 U.S.C. 154(b) by 240 days.

(21) Appl. No.: 12/872,327

(22) Filed: Aug. 31, 2010

(65) Prior Publication Data

US 2011/0052226 A1 Mar. 3, 2011

(30) Foreign Application Priority Data

Sep. 2, 2009 (JP) ..... 2009-202216

(51) Int. Cl.
*G03G 15/00* (2006.01)
*G03G 15/16* (2006.01)

(52) U.S. Cl.
USPC ..... 399/44; 399/66

(58) Field of Classification Search ..... 399/44, 399/66, 46, 50, 53
See application file for complete search history.

(56) References Cited

U.S. PATENT DOCUMENTS

| | | | | |
|---|---|---|---|---|
| 7,120,367 | B2 * | 10/2006 | Kyung et al. | 399/44 |
| 2001/0028803 | A1 * | 10/2001 | Yoda | 399/44 |
| 2008/0212987 | A1 * | 9/2008 | Kim | 399/44 |

FOREIGN PATENT DOCUMENTS

| | | | |
|---|---|---|---|
| JP | 64-15777 | A | 1/1989 |
| JP | 11-167243 | A | 6/1999 |
| JP | 2000-98771 | A | 4/2000 |
| JP | 2001-296759 | A | 10/2001 |
| JP | 2003-66743 | A | 3/2003 |
| JP | 2007-156201 | A | 6/2007 |

OTHER PUBLICATIONS

Notification of Reason for Refusal for Japanese Patent Application No. 2009-202216, drafted Aug. 11, 2011, mailed Aug. 16, 2011, with English translation.
The First Office Action of Chinese Application No. 201010271510.4, issued May 22, 2012, with English translation.
The Second Office Action for Chinese Application No. 201010271510.4, issued Feb. 26, 2013, with English translation.

* cited by examiner

*Primary Examiner* — Sophia S Chen
(74) *Attorney, Agent, or Firm* — Cantor Colburn LLP

(57) ABSTRACT

An image forming apparatus for performing image formation by using an electrophotographic process, the image forming apparatus including: a control section for judging existence of necessity of correction of process conditions in the electrophotographic process based on environment dependence characteristic information of a resistance value of a member that is used for the electrophotographic process and constitutes the image forming apparatus and environment change information in the own apparatus, and performing the correction based on the result of the judgment.

13 Claims, 10 Drawing Sheets

FIG. 6

TRANSFER VOLTAGE CONTROL JUDGMENT TABLE

| ENVIRONMENT CHANGE INFORMATION | CHANGED TEMPERATURE FOR TRANSFER VOLTAGE CONTROL EXECUTION |
|---|---|
| 0 TO 0.50 | EVERY 1℃ |
| 0.51 TO 1.00 | EVERY 2℃ |
| 1.01 TO 1.50 | EVERY 3℃ |
| 1.51 TO 2.00 | EVERY 5℃ |
| 2.01 TO 2.50 | EVERY 8℃ |
| 2.51 TO 3.00 | EVERY 10℃ |
| 3.01 OR MORE | EVERY 15℃ |

IMAGE FORMING APPARATUS, STORAGE MEDIUM AND IMAGE FORMING METHOD

BACKGROUND OF THE INVENTION

1. Field of the Invention

The present invention relates to an image forming apparatus, a storage medium and an image forming method.

2. Description of the Related Art

An image forming apparatus (of electrophotographic printing system), which performs image formation by using an electrophotographic process, generally forms (prints) an image on a sheet of paper or the like by using electrostatic elements and operations, such as charges and electrostatic attraction at the time of image formation.

Consequently, if the situations of the internal temperature and humidity of the image forming apparatus change, the process conditions of the electrophotographic process (especially process conditions of a transfer process) are influenced by the changes to vary. As a result, the image quality of an image printed on a sheet of paper sometimes does not become desired one.

In order to solve such a problem, the technique of detecting the internal temperature and humidity of an image forming apparatus to correct the process conditions of an electrophotographic process on the basis of the detected values was disclosed (see Japanese Patent Application Laid-Open Publications No. H 11-167243 and No. 2000-98771).

Furthermore, the technique of detecting not only the inside of an image forming apparatus but also the external environment state to correct the process conditions of an electrophotographic process on the basis of these detected values was also disclosed (see Japanese Patent Application Laid-Open Publication No. 2007-156201).

Furthermore, the technique referring to the history of the internal environment (temperature and humidity) of an image forming apparatus to always perform correction was also disclosed (see Japanese Patent Application Laid-Open Publication No. 2001-296759).

The environment (temperature and humidity) in an image forming apparatus is, however, in the process of changing during an operation of an image forming apparatus. Even if the correction of the process conditions of an electrophotographic process is performed in such a situation on the basis of the detected environment conditions (temperature, humidity) and history by using the techniques disclosed in Japanese Patent Application Laid-Open Publications No. H 11-167243, No. 2000-98771, No. 2007-156201 and No. 2001-296759, the corrected process conditions do not become proper ones. Consequently, the image quality of an image printed on a sheet of paper does not become a desired one.

BRIEF SUMMARY OF THE INVENTION

The present invention was made in view of the problem described above, and aims to perform the correction of proper process conditions of an image forming apparatus under the conditions of the environment being in the process of changing.

According to a first aspect of the present invention, there is provided an image forming apparatus for performing image formation by using an electrophotographic process, including: a control section for judging existence of necessity of correction of process conditions in the electrophotographic process based on environment dependence characteristic information of a resistance value of a member that is used for the electrophotographic process and constitutes the image forming apparatus and environment change information in the own apparatus, and for performing correction based on a result of the judgment.

According to a second aspect of the present invention, there is provided a computer-readable storage medium to store a program for causing the computer to function as a control section for judging existence of necessity of correction of process conditions in an electrophotographic process based on environment dependence characteristic information of a resistance value of a member that is used for the electrophotographic process and constitutes an image forming apparatus and environment change information in the image forming apparatus, the control section performing the correction based on a result of the judgment. According to a third aspect of the present invention, there is provided an image forming method executed by an image forming apparatus for performing image formation by using an electrophotographic process, the method including the steps of: judging existence of necessity of correction of process conditions in the electrophotographic process based on environment dependence characteristic information of a resistance value of a member, which is used for the electrophotographic process and constitutes the image forming apparatus, and environment change information in the image forming apparatus; and performing the correction based on a result of the judgment obtained in the judging step.

According to the first, second and third aspects of the present invention, it is possible to properly correct the process conditions in an image forming apparatus under the conditions of an environment being the in process of changing.

BRIEF DESCRIPTION OF THE DRAWINGS

In the following, these and other objects, advantages, and configurations of the present invention will be more fully understood from the detailed description given below and the accompanying drawings. The following description pertaining to the implementation of the present invention is not intended to limit the scope of the present invention, and wherein.

FIG. 6 is a data configuration diagram of a transfer voltage control judgment table;

DESCRIPTION OF THE PREFERRED EMBODIMENTS

In the following, a first embodiment of an image forming apparatus of the present invention will be described with reference to FIGS. 1-7.

Figure 1:
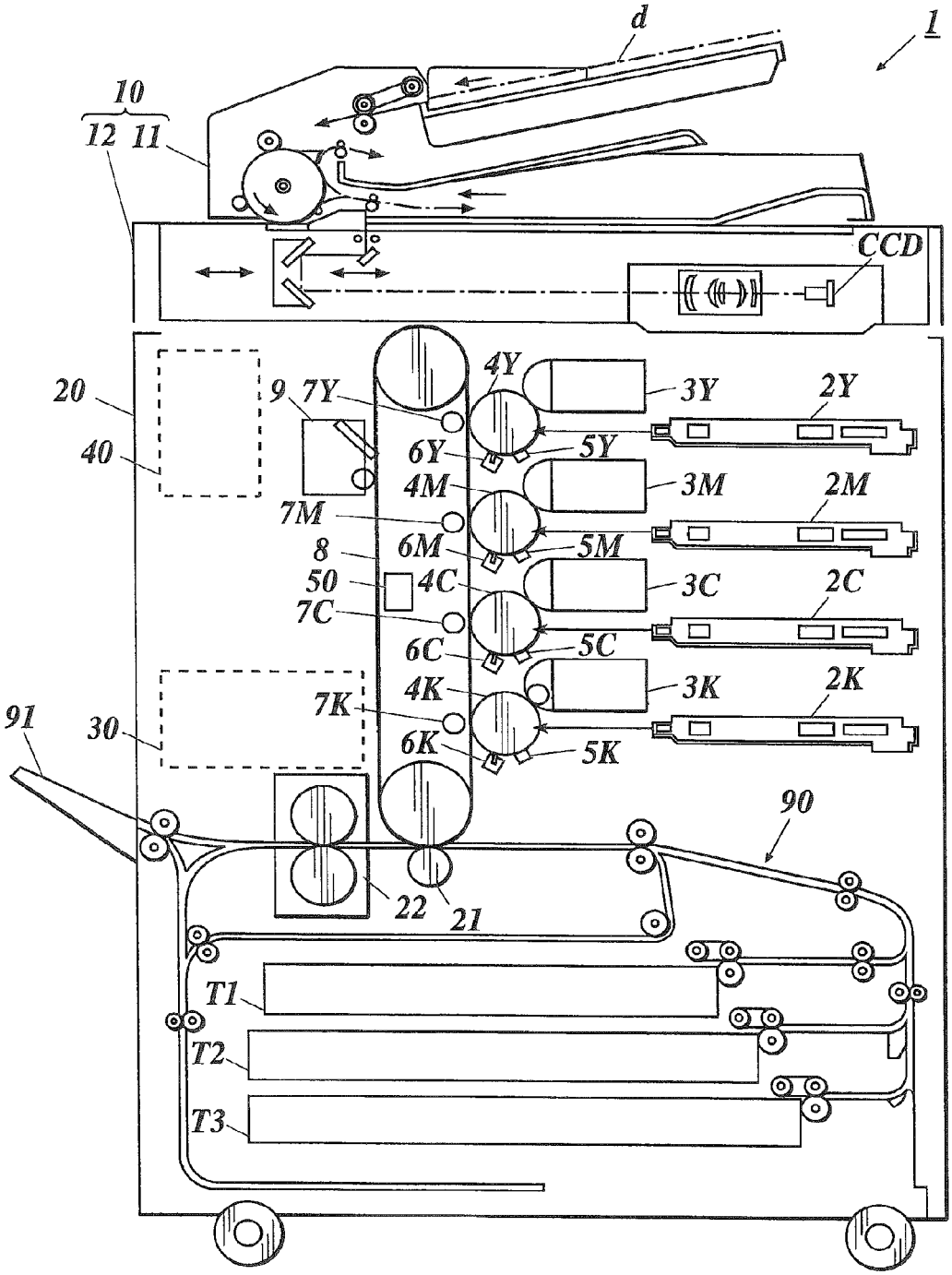
FIG. 1 is a view showing an example of a functional configuration of an image forming apparatus according to a first embodiment of the present invention.

First, the configuration thereof will be described. FIG. 1 shows an example of the functional configuration of the image forming apparatus 1 of the first embodiment of the present invention. As shown in FIG. 1, the image forming apparatus 1 is composed of an image reading section 10, an image forming section 20, a power source section 30, a control section 40, and a conveyance section 90.

The image reading section 10 is composed of an automatic original paper feeding apparatus 11, an original image scanning apparatus 12, and the like. The automatic original paper feeding apparatus 11 conveys an original d placed on an original stand with a conveyance mechanism to send out the original d to the original image scanning apparatus 12. The original image scanning apparatus 12 performs the light scanning on the conveyed original d and performs the photoelectric conversion on the original image on the original d to read the original image with a sensor charge coupled device (CCD).

The original image (analog image signal) read by the image reading section 10 is output to the control section 40, described below, and is subjected to various kinds of image processing, such as analog processing, analog-to-digital (A/D) conversion processing, shading correction, and image compression processing. Then, the processed original image is subjected to color separation into each color of yellow (Y), magenta (M), cyan (C), and black (K) to be output to the exposure units 2Y, 2M, 2C, and 2K of the image forming section 20 as image data to be output.

In addition, the automatic original paper feeding apparatus 11 includes a conveyance mechanism for reading both sides of an original, and can consecutively read the images of many originals d (including both sides) conveyed from the original stand at a stretch. The read data of the original images is stored in the internal image memory of the image forming section 20 and will sequentially be read as output data at the time of being output to be output to the exposure units 2Y, 2M, 2C, and 2K. This function is used in the case of copying many original images by means of a copying function, the case of transmitting the data of many originals d by means of a facsimile function, and the like.

The image forming section 20 performs image formation on sheets of paper by a tandem system, and is equipped with the exposure units 2Y, 2M, 2C, and 2K, which are light emitting devices or the like, development units 3Y, 3M, 3C, and 3K, photosensitive drums 4Y, 4M, 4C, and 4K, primary transfer rollers 7Y, 7M, 7C, and 7K, an intermediate transfer belt 8, and the like, which are arranged in lines in the main scanning direction to the respective colors Y, M, C, and K. Charging sections 5Y, 5M, 5C, and 5K for performing charging, and cleaning sections 6Y, 6M, 6C, and 6K for removing the residual toner on the photosensitive drums 4Y, 4M, 4C, and 4K, respectively, are provided around the photosensitive drums 4Y, 4M, 4C, and 4K, respectively. In the following, the primary transfer rollers 7Y, 7M, 7C, and 7K will collectively be called a primary transfer roller 7 for convenience for description.

Furthermore, the image forming section 20 includes a secondary transfer roller 21 for transferring a toner image transferred on the intermediate transfer belt 8 onto a sheet of paper and a fixing section 22 for performing the heat fixing of the toner image transferred on the sheet of paper. The intermediate transfer belt 8 is rotatably supported by a plurality of rollers winding the intermediate transfer belt 8 around itself. A cleaning section 9 for removing the residual toner on the intermediate transfer belt 8 is provided to face the intermediate transfer belt 8.

The image formation in the image forming section 20 is performed by forming an electrostatic latent image of each of the photosensitive drums 4Y, 4M, 4C, and 4K of the colors Y, M, C, and K by the exposure units 2Y, 2M, 2C, and 2K, respectively, by forming a toner image on the intermediate transfer belt 8 by attaching toner to the electrostatic latent image, by transferring the toner image to a sheet of paper, and by performing the heat fixing of the toner image on the sheet of paper with the fixing section 22, under the control of the control section 40, described below. The series of processes is called an electrophotographic process.

A detection section 50 is provided in the neighborhood of the intermediate transfer belt 8 in the image forming section 20 to periodically detect the temperature and the humidity in the neighborhood of the intermediate transfer belt 8. The detection section 50 outputs the information of detection results to the control section 40.

The power source section 30 is connected to a not-shown commercial alternating current power source and converts the alternating current (AC) power source power input from the commercial alternating current power source into the direct current (DC) power source power to supply necessary voltages to the respective sections. The power source section 30 performs the power source supply in conformity with control instructions from the control section 40.

Figure 2:
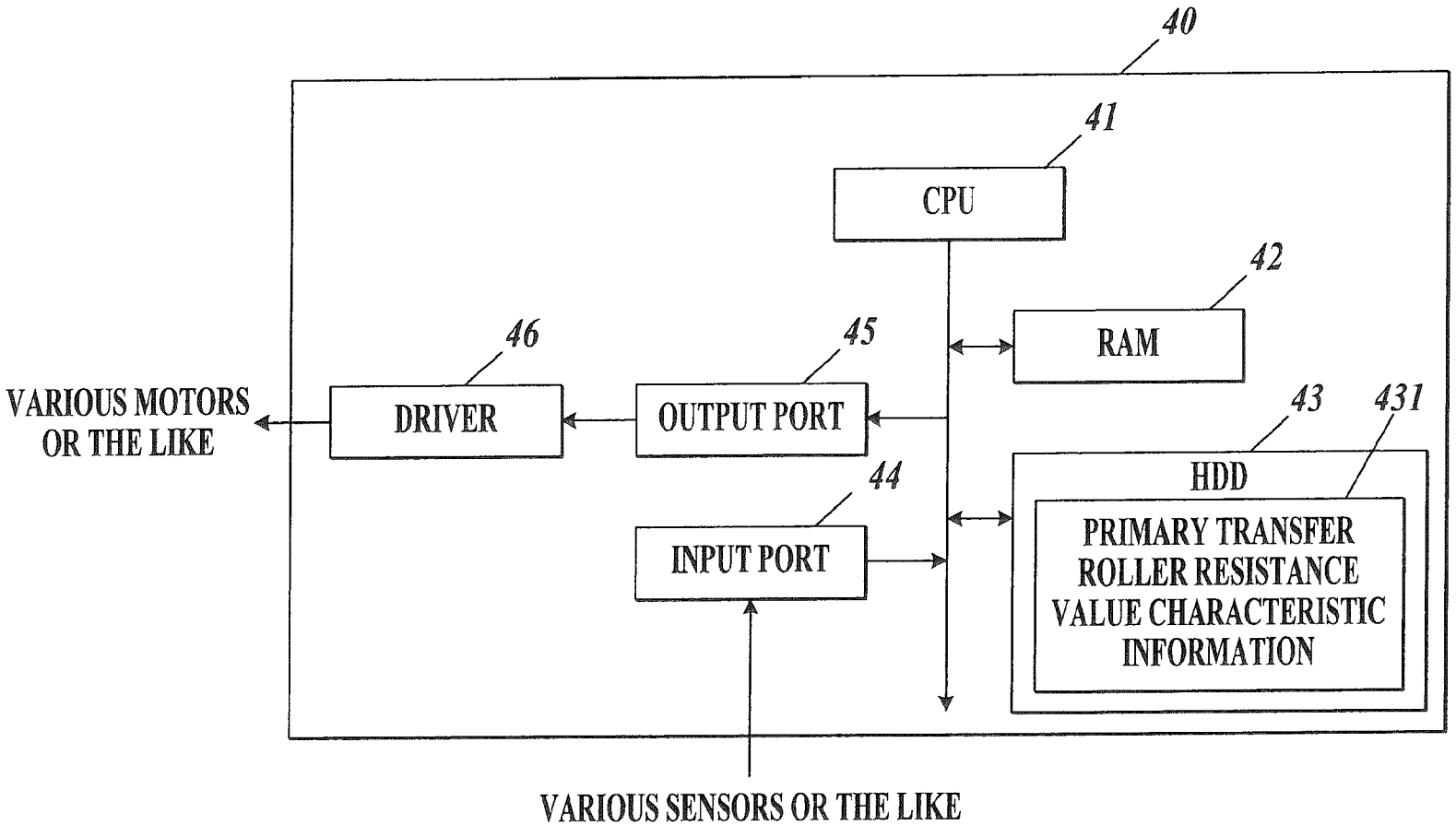
FIG. 2 is a block diagram showing an example of a functional configuration of a control section.

The control section 40 is a control drive circuit for collectively controlling the operations of the image forming apparatus 1. As shown in FIG. 2, the control section 40 is composed of a central processing unit (CPU) 41, a random access memory (RAM) 42, a hard disk drive (HDD) 43, an input port 44, an output port 45, and a driver 46.

The control section 40 collectively controls the operations of the imaging forming apparatus 1 by reading control programs, application programs, and various set data, each stored in a storage medium, such as the HDD 43 and a ROM (not shown), in a format capable of being read by the CPU 41, and by sequentially executing the read programs and data with the CPU 41 by using a predetermined area in the RAM 42 as a working area. Furthermore, the control section 40 performs the aforesaid various kinds of image processing by sequentially executing the programs mentioned above.

The HDD 43 stores primary transfer roller resistance value characteristic information 431. The primary transfer roller resistance value characteristic information 431 is the information indicating a resistance value of the primary transfer roller 7 in the case where the primary transfer roller 7 is left as it is in a certain environment (of a specific temperature and humidity) for a sufficiently long period. The details of the primary transfer roller resistance value characteristic information 431 will be described later.

The input port 44 is an interface receiving signals from various sensors (for example, detection section 50), installed in various places of the image forming apparatus 1, to output the received signals to the CPU 41.

The output port 45 is an interface to output the control signals output by the CPU 41 to the driver 46.

The driver 46 takes charge of the drive control and the like of the various motors installed in various places of the image forming apparatus 1 on the basis of the control signals output from the output port 45.

The control section 40 performs various kinds of processing on the basis of the information (temperature and humidity) of the detection results from the detection section 50 and performs the correction of the transfer voltage of the primary transfer roller 7. Namely, the control section 40 outputs a control instruction to the power source section 30 through the driver 46. The control instruction indicates instructing the power source section 30 to supply a voltage value after correction to the primary transfer roller 7.

The conveyance section 90 conveys sheets of paper placed in paper trays T1-T3 capable of being controlled by an automatic tray switching (ATS) paper feeding function to the respective sections along a conveyance pathway by a conveying roller mechanism or the like and ejects the sheets of paper to a copy receiving tray 91 on the outside of the image forming apparatus 1. To put it concretely, the conveyance section 90 performs the conveyance of sheets of paper placed in the paper trays T1-T3 to the secondary transfer roller 21, the conveyance of sheets of paper after transfer of toner images by the secondary transfer roller 21 to the fixing section 22, the paper ejection of sheets of paper subjected to heat fixing by the fixing section 22 to the copy receiving tray 91, and the like.

Figure 3:
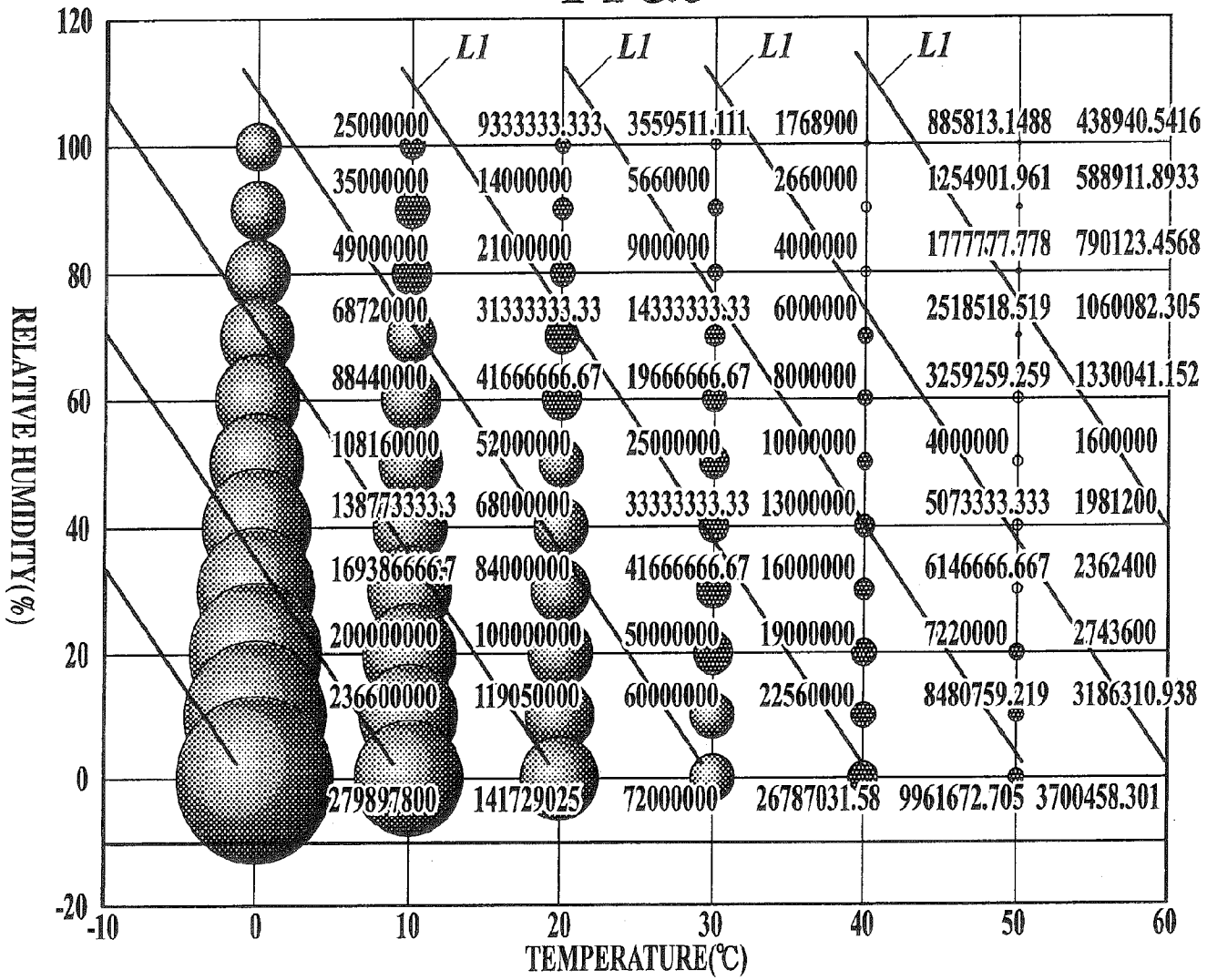
FIG. 3 is a graph showing primary transfer roller environment dependence characteristic information.

FIG. 3 shows the primary transfer roller resistance value characteristic information 431 as a graph. The graph is called primary transfer roller resistance value characteristic information graph.

As shown in FIG. 3, the abscissa axis of the primary transfer roller resistance value characteristic information graph indicates temperatures (° C.), and the ordinate axis thereof indicates relative humidity (%). The relative humidity is synonymous with humidity. Furthermore, the size of a circle of the graph indicates the magnitude of the resistance value of the primary transfer roller 7 when the primary transfer roller 7 is left as it is in a corresponding environment (temperature, humidity) for a sufficiently long period.

A regression line obtained by using, for example, the method of least squares on the basis of the points corresponding to the environments (temperatures, humidity) in which the resistance values of the primary transfer roller 7 become comparable levels, i.e. the pints at which the sizes of the circles on the graph become comparable levels, is denoted by a straight line L1 here. Then, all of the inclinations of the respective straight lines L1 corresponding to the respective sizes are equal to one another. The equal inclination is called "inclination a." The inclination a becomes the environment dependence characteristic information of the primary transfer roller 7. From FIG. 3, the environment dependence characteristic information (inclination a) is "−3.33."

Figure 4:
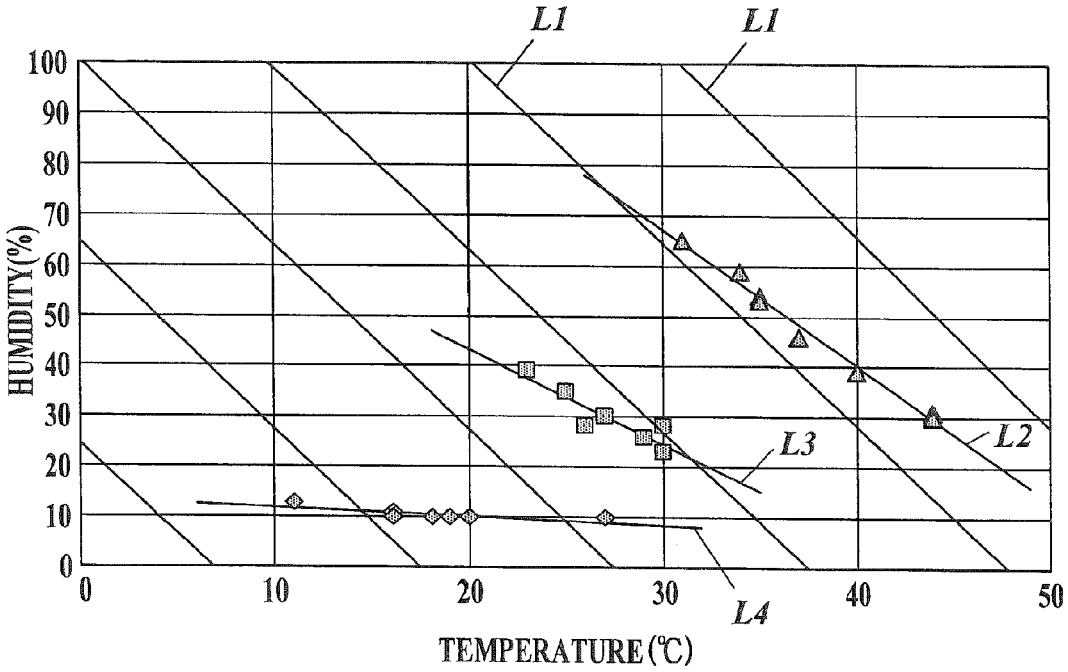
FIG. 4 is a graph showing environment changes in the image forming apparatus.

FIG. 4 is a graph showing environment changes in the image forming apparatus 1. The graph is called an environment change graph. To put it concretely, the environment change graph is a graph showing the changes of the temperature and the humidity that the detection section 50 detects when the image forming apparatus 1 is operated.

As shown in FIG. 4, the abscissa axis of the environment change graph indicates temperatures (° C.), and the ordinate axis thereof indicates humidity (%). The axes of the environment change graph are similar to those of the primary transfer roller resistance value characteristic information graph mentioned above. Then, the straight lines L1 are straight lines each having the inclination a, and indicate the straight lines L1 of the primary transfer roller resistance value characteristic information graph.

Furthermore, Δ's (triangles) denote points plotted in accordance with the changes of the temperatures and the humidity that were periodically detected by the detection section 50 when the image forming apparatus 1 was operated in the environment of the temperature of 30° C. and the humidity of 80% around the image forming apparatus 1. The regression line obtained by using, for example, the method of least squares on the basis of these points is denoted by a straight line L2 here. Then, the values of the temperatures and the humidity detected by the detection section 50 almost transit along the straight line L2. To put it concretely, when the image forming apparatus 1 is operated, the temperature thereof transits from a lower point to a higher point. Furthermore, when the image forming apparatus 1 is stopped, the temperature thereof transits from a higher point to a lower point.

Similarly, □'s (quadrilaterals) denote points plotted in accordance with the changes of the temperatures and the humidity that were periodically detected by the detection section 50 when the image forming apparatus 1 was operated in the environment of the temperature of 20° C. and the humidity of 50% around the image forming apparatus 1. The regression line obtained by using, for example, the method of least squares on the basis of these points is denoted by a straight line L3 here. Then, the values of the temperatures and the humidity detected by the detection section 50 almost transit along the straight line L3.

Similarly, ◇'s (rhombuses) denote points plotted in accordance with the changes of the temperatures and the humidity that were periodically detected by the detection section 50 when the image forming apparatus 1 was operated in the environment of the temperature of 10° C. and the humidity of 20% around the image forming apparatus 1. The regression line obtained by using, for example, the method of least squares based on the basis of these points is denoted by a straight line L4 here. Then, the values of the temperatures and the humidity detected by the detection section 50 almost transit along the straight line L4.

The nearer the inclinations of the straight lines (straight lines L2, L3, L4, and the like) indicating the environment changes in the image forming apparatus 1 are to the inclination a of the straight line L1, the smaller the changes of the resistance value of the primary transfer roller 7 become here. From FIG. 4, if the image forming apparatus 1 is operated in the environment of the temperature of 30° C. and the humidity of 80%, the changes of the resistance value of the primary transfer roller 7 becomes smaller than those of the other environments. Furthermore, if the image forming apparatus 1 is operated in the environment of the temperature of 10° C. and the humidity of 20%, the changes of the resistance value of the primary transfer roller 7 becomes larger than these of the other environments.

Next, the concrete operation of the generation processing of the correction execution judgment information, which generation processing is executed by the control section 40 of the image forming apparatus 1, will be described with reference to FIG. 5. The correction execution judgment information indicates the environment dependence characteristic information of the primary transfer roller 7, a transfer voltage control judgment table, and the like here.

Figure 5:
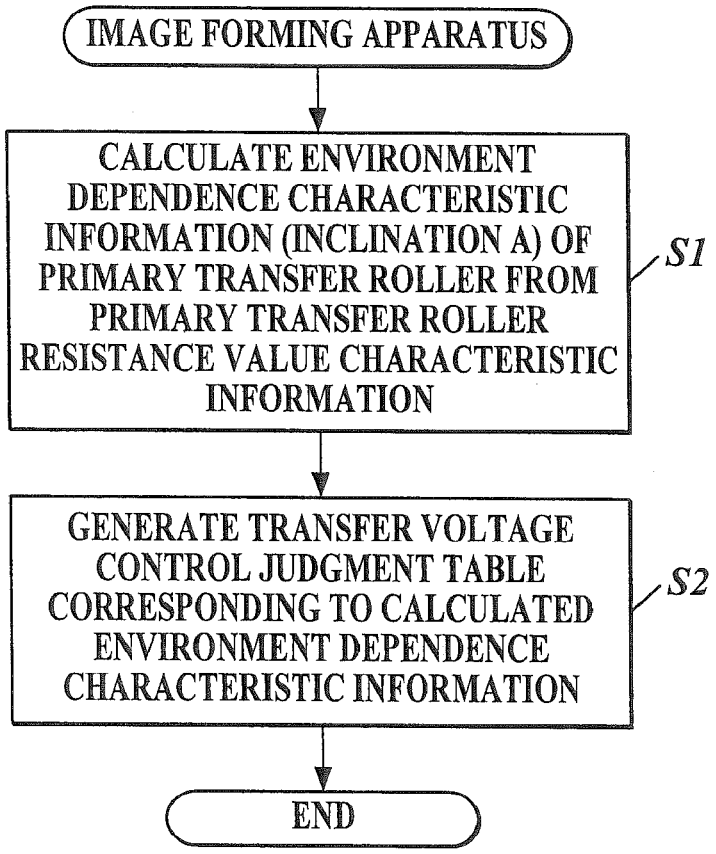
FIG. 5 is a flow chart diagram showing a generation processing of correction execution judgment information.

As shown in FIG. 5, the control section 40 calculates the environment dependence characteristic information of the primary transfer roller 7 from the primary transfer roller resistance value characteristic information 431 shown in FIG. 3 (Step S1). To put it concretely, the control section 40 calculates the inclination a of the straight line L1 in the primary transfer roller resistance value characteristic information graph (see FIG. 3).

Next, the control section 40 generates a transfer voltage control judgment table corresponding to the calculated environment dependence characteristic information (inclination a) of the primary transfer roller 7 (Step S2).

To put it concretely, an area on the primary transfer roller resistance value characteristic information graph is partitioned by a plurality of straight lines L1 (see FIGS. 3 and 4). Then, if the points corresponding to the temperatures and humidity detected by the detection section 50 stride the areas, the control section 40 generates a transfer voltage control judgment table to correct the transfer voltage of the primary transfer roller 7. Namely, the values of the items (described below) of the transfer voltage control judgment table depend on the widths of the plurality of straight lines L1 on the primary transfer roller resistance value characteristic information graph. The widths between the straight lines L1 are previously set by a user's operation with a not-shown operation section.

FIG. 6 shows the generated transfer voltage control judgment table corresponding to the environment dependence characteristic information "−3.33." As shown in FIG. 6, the transfer voltage control judgment table is composed of one or a plurality of records including items "environment change information" and "changed temperature for transfer voltage control execution."

The item "environment change information" is each of the ratios between the absolute values of the differences between the respective temperatures detected by the detection section 50 at certain times (first times) and at later certain times (second times) and the absolute values of the differences between the pieces of humidity detected by the detection section 50 at the first and second times. The details of the "environment change information" will be described later.

The item "changed temperature for transfer voltage control execution" is each of change widths of the temperatures detected by the detection section 50 as the conditions for performing correction of the transfer voltages to the primary transfer roller 7, which correction is performed by the control section 40. For example, when the environment change information is "1.55," the control section 40 performs the correction of the transfer voltage to the primary transfer roller 7 every 5° C. of the change width of the temperature detected by the detection section 50.

Next, a concrete operation of the transfer voltage correcting processing executed in the image forming apparatus 1 will be described with reference to FIG. 7.

Figure 7:
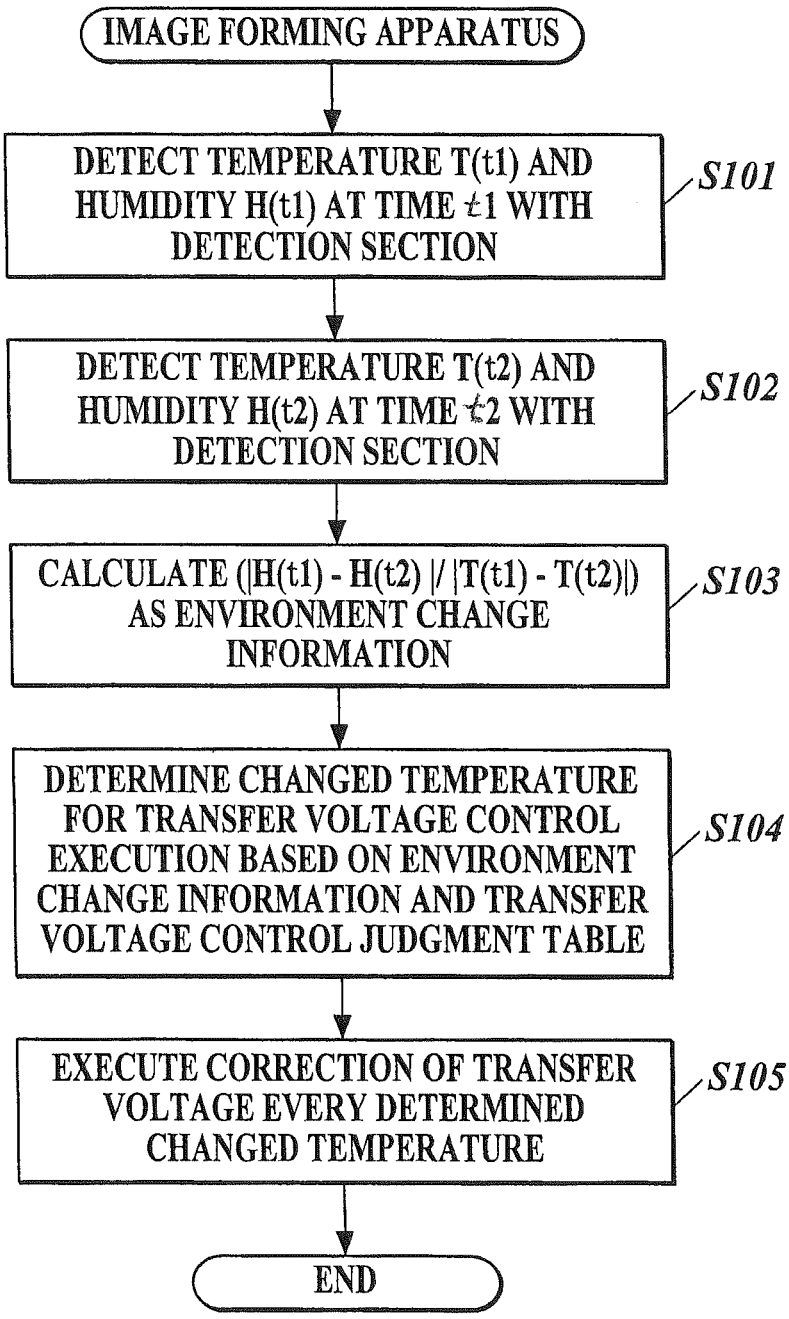
FIG. 7 is a flowchart diagram showing transfer voltage correcting processing.

As shown in FIG. 7, the detection section 50 detects a temperature T(t1) and a piece of humidity H(t1) at a certain time t1 (Step S101). Then, the detection section 50 detects a temperature T(t2) and a piece of humidity H(t2) at a certain time t2 later than the time t1 (Step S102).

The control section 40 calculates the environment change information on the basis of the temperatures T(t1) and T(t2) and the pieces of humidity H(t1) and H(t2), detected by the detection section 50 (Step S103). To put it concretely, the control section 40 calculates the environment change information by means of the following formula (1). Namely, the environment change information is each of the inclinations of the straight lines (straight lines L2, L3, L4, and the like) indicating the environment changes in the primary transfer roller resistance value characteristic information graph (see FIG. 4).

$$\text{Environment Change Information}=(|H(t1)-H(t2)|)/(|T(t1)-T(t2)|) \quad (1)$$

Then, the control section 40 determines the changed temperature for transfer voltage control execution on the basis of the environment change information and the generated transfer voltage control judgment table (Step S104). For example, if the environment change information is 1.05, the changed temperature for transfer voltage control execution is every 3° C. according to FIG. 6.

The control section 40 executes the correction of the transfer voltage of the primary transfer roller 7 (the correction of process conditions in an electrophotographic process) every determined changed temperature (Step S105). To put it concretely, the HDD 43 stores the optimum transfer voltage value of each environment (temperature and humidity). The control section 40 executes the correction of the transfer voltage by referring to the transfer voltage value. With that, the processing ends.

As described above, according to the first embodiment, the control section 40 of the image forming apparatus 1 calculates the environment dependence characteristic information of the primary transfer roller 7 from the primary transfer roller resistance value characteristic information 431 (see FIG. 3), stored in the HDD 43. Furthermore, the detection section 50 of the image forming apparatus 1 detects the temperature and the humidity in the neighborhood of the intermediate transfer belt 8 at the certain times t1 and t2. The control section 40 calculates the environment change information on the basis of the detected information. The control section 40 judges the existence of the necessity of the correction of the process conditions in an electrophotographic process, namely, the existence of the necessity of the correction of the transfer voltage to the primary transfer roller 7, on the basis of the calculated environment dependence characteristic information and the environment change information. Then, the control section 40 performs the correction on the basis of the judgment result (changed temperature for transfer voltage control execution).

Consequently, the proper correction of the process conditions of an electrophotographic process in an image forming apparatus can be performed under the conditions of being in the process of environment changing.

Next, a second embodiment of the image forming apparatus of the present invention will be described with reference to FIGS. 8-10. The respects differ from those of the first embodiment described above will mainly be described here.

Figure 8:
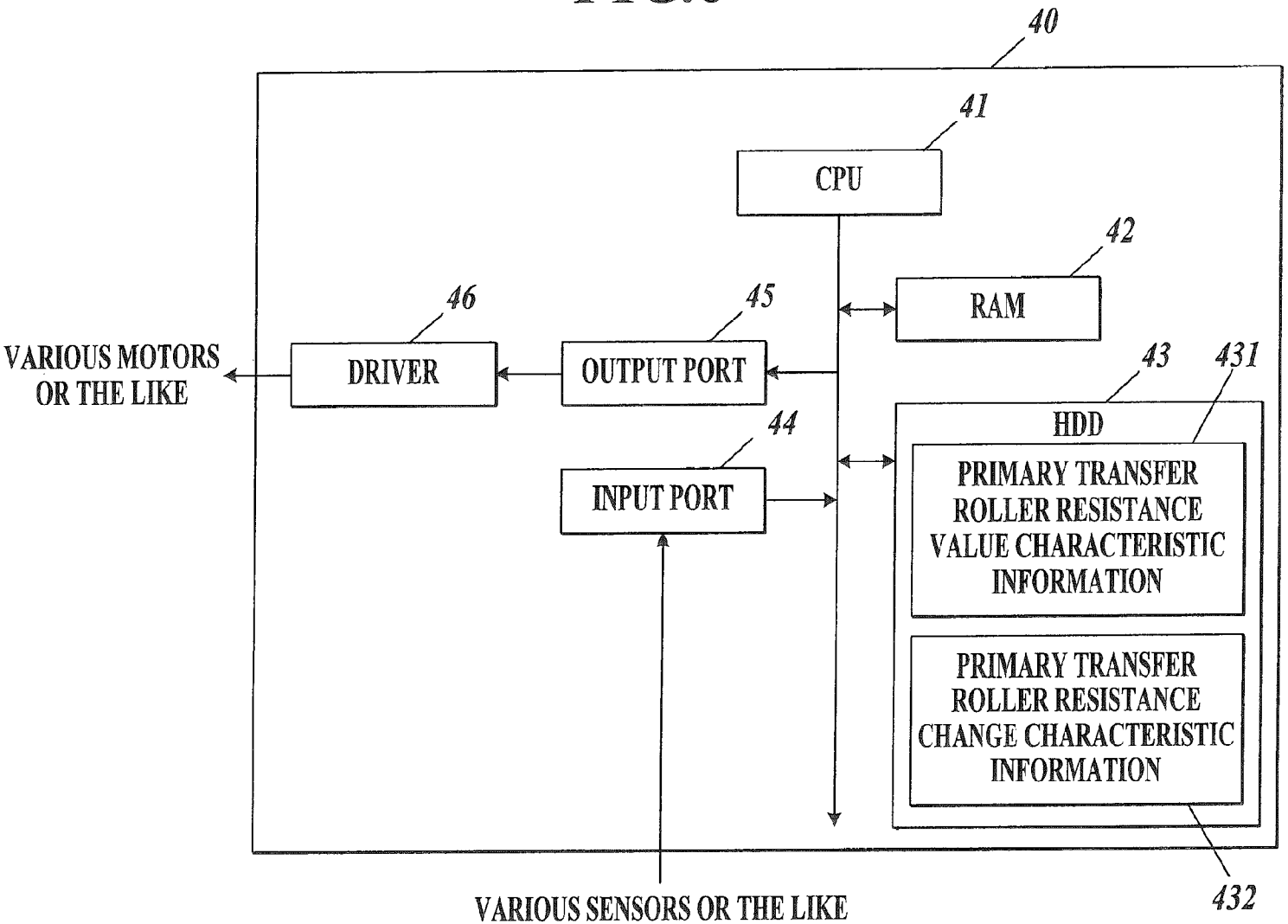
FIG. 8 is a block diagram showing an example of a functional configuration of a control section according to a second embodiment of the present invention.

FIG. 8 shows the functional configuration of the control section 40 according to the second embodiment of the present invention. As shown in FIG. 8, the HDD 43 stores the primary transfer roller resistance value characteristic information 431 and primary transfer roller resistance change characteristic information 432.

Furthermore, the control section 40 also functions as a measurement section for measuring a time.

The primary transfer roller resistance change characteristic information 432 is the information indicating a change characteristic of the resistance value of the primary transfer roller 7 accompanying a change of the environment (temperature, humidity) around the primary transfer roller 7. FIG. 9 shows the primary transfer roller resistance change characteristic information 432 as a graph. The graph is called a primary transfer roller resistance change characteristic information graph.

Figure 9:
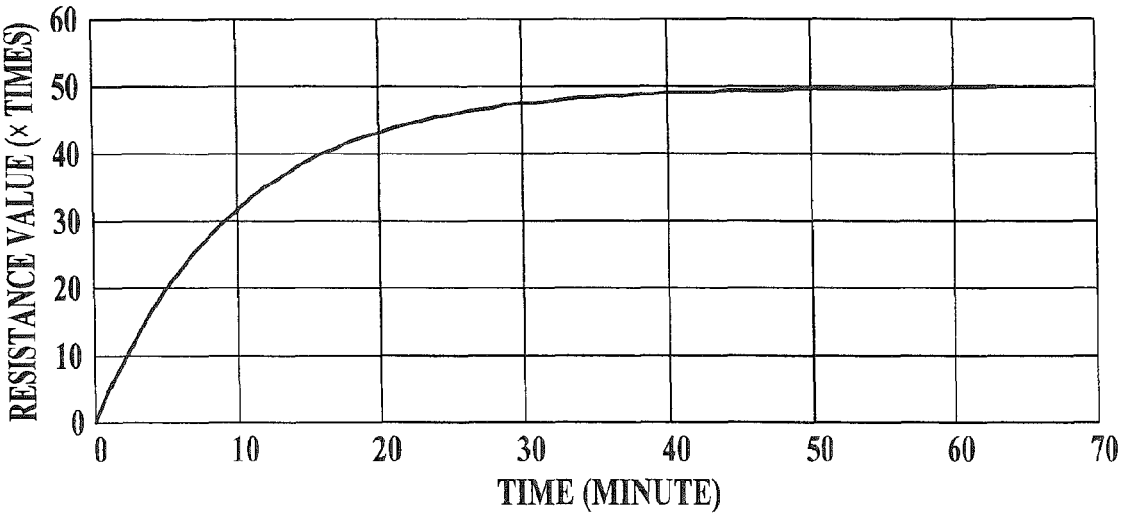
FIG. 9 is a graph showing primary transfer roller resistance change characteristic information.

As shown in FIG. 9, the abscissa axis of the primary transfer roller resistance change characteristic information graph indicates time (minutes), and the ordinate axis thereof indicates the magnification ratios of the resistance value of the primary transfer roller 7. The primary transfer roller resistance change characteristic information is expressed by the following formula (2) here.

$$\text{Magnification Ratio of Resistance Value}=C\times(1-\text{EXP}(-t)/10) \quad (2)$$

The letter C denotes a constant taking a value corresponding to the state of each environment change. In FIG. 9, the changes of the resistance value of the primary transfer roller 7 in the case where the temperature and the humidity thereof changed from 30° C. and 80% at the time point of time 0 to 10° C. and 20%, respectively, are shown. At this time, the value of the constant C becomes "50." The value of the constant C can take a negative value.

The HDD 43 stores the formula (2) of the primary transfer roller resistance change characteristic information 432.

Next, the concrete operation of the transfer voltage correcting processing to be executed in the image forming apparatus 1 will be described with reference to FIG. 10.

Figure 10:
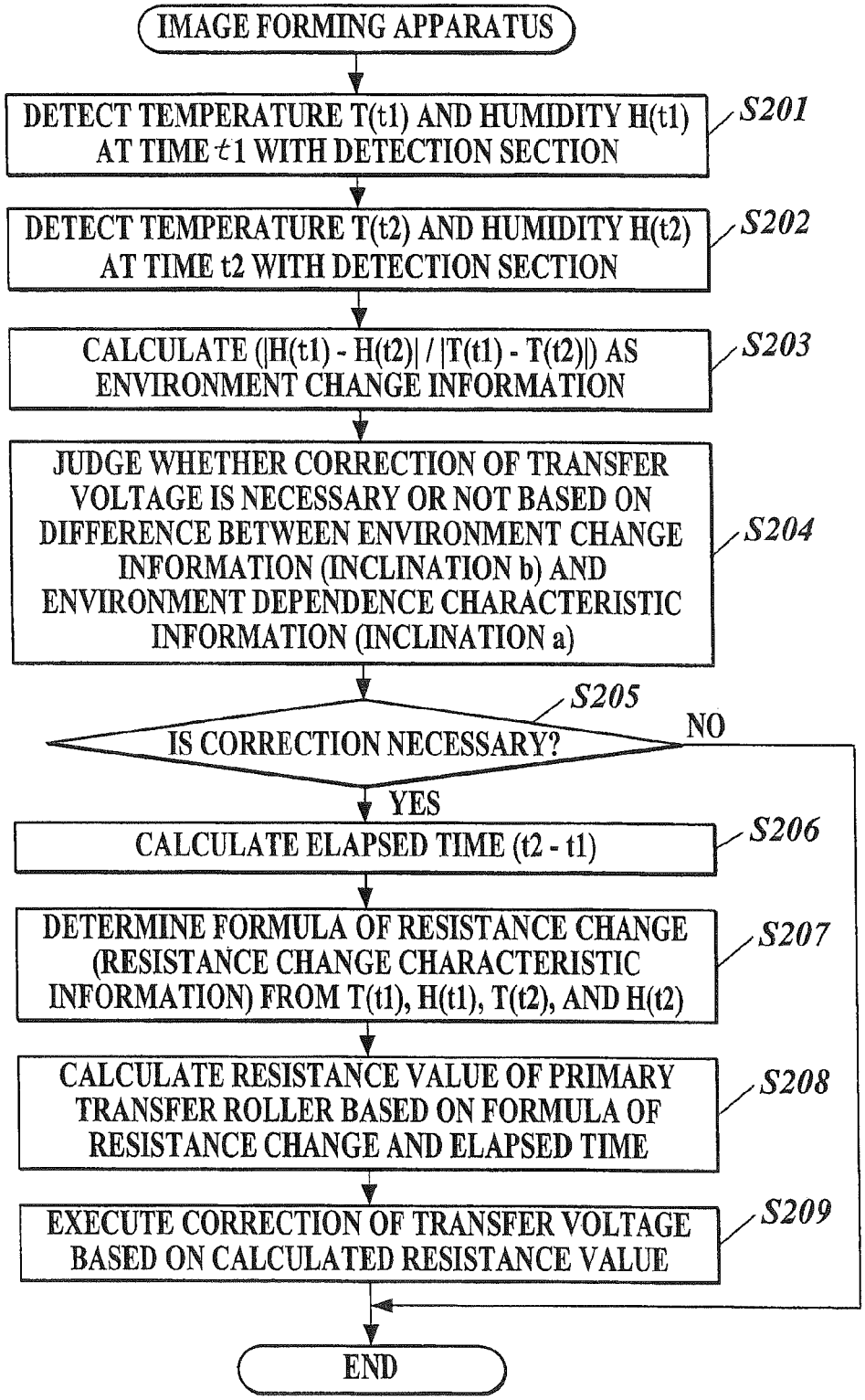
FIG. 10 is a flow chart diagram showing transfer voltage correcting processing.

As shown in FIG. 10, the detection section 50 detects the temperature T(t1) and the piece of humidity H(t1) at the certain time t1 (Step S201). Then, the detection section 50 detects the temperature T(t2) and the piece of humidity H(t2) at the certain time t2 later than the time t1 (Step S202). Furthermore, the control section 40 causes the RAM 42 to store the information at the times t1 and t2.

The control section 40 calculates the environment change information on the basis of the temperatures T(t1) and T(t2) and the pieces of humidity H(t1) and H(t2), detected by the detection section 50 (Step S203). To put it concretely, the control section 40 calculates the environment change information by using the formula (1) mentioned above. Namely, the environment change information indicates the inclinations (inclinations b) of straight lines (straight lines L2, L3, L4, and the like) showing the environment changes in the primary transfer roller resistance value characteristic information graph.

Then, the control section 40 judges the existence of the necessity of the correction of the transfer voltage of the primary transfer roller 7 (step S204) on the basis of the difference (|b−a|) between the environment change information (inclination b) and the environment dependence characteristic information (inclination a).

To put it concretely, the control section 40 judges whether the difference between the environment change information (inclination b) and the environment dependence characteristic information (inclination a) is larger than a correction execution judgment threshold value or not. If the absolute value of the difference between the environment change information (inclination b) and the environment dependence characteristic information (inclination a) is larger than the correction execution judgment threshold value, the control section 40 judges that the necessity of the correction of the transfer voltage of the primary transfer roller 7 exists. Furthermore, in the other cases, the control section 40 judges that no necessity of the correction of the transfer voltage of the primary transfer roller 7 exists. The correction execution judgment threshold value is previously set by a user's operation with a not-shown operation section.

If no necessity of the correction exists as the result of the judgment at Step S204 (Step S205: NO), the control section 40 ends the processing.

On the other hand, if the necessity of the correction exists as the result of the judgment (Step S205: YES), the control section 40 calculates an elapsed time (t2−t1) on the basis of the information at the times t1 and t2, which information is stored in the RAM 42 (Step S206).

Then, the control section 40 determines the formula (resistance change characteristic information) of the resistance change on the basis of the temperature T(t1) and the piece of humidity H(t1) at the time t1 and the temperature T(t2) and the piece of humidity H(t2) at the time t2, which were detected by the detection section 50 (Step S207).

To put it concretely, the control section 40 determines the value of the constant C of the formula (2), which indicates the resistance change characteristic information. The control section 40 referrers to the primary transfer roller resistance value characteristic information 431 to set the ratio of the resistance values of the primary transfer roller 7 left as it is in the environment of temperature T(t2) and the humidity H(t2) for a sufficiently long time to the resistance value of the primary transfer roller 7 left as it is in the environment of the temperature T(t1) and the humidity H(t1) for a sufficiently long time as the constant C.

Then, the control section 40 calculates the resistance value of the primary transfer roller 7 on the basis of the formula of the resistance change (resistance change characteristic information) determined at Step S207 and the elapsed time (Step S208). For example, if the value of the constant C is 50 (see FIG. 9) and the elapsed time is 10 minutes, the resistance value magnification ratio is about 30 times.

Then, the control section 40 executes the correction of the transfer voltage of the primary transfer roller 7 on the basis of the calculated resistance value (Step S209). To put it concretely, the control section 40 also makes the transfer voltage of the primary transfer roller 7 30 times on the basis of the Ohm's law if the resistance value becomes 30 times. With that, the processing ends.

As described above, according to the second embodiment, the control section 40 of the image forming apparatus 1 calculates the environment dependence characteristic information of the primary transfer roller 7 from the primary transfer roller resistance value characteristic information 431, stored in the HDD 43. Furthermore, the detection section 50 of the image forming apparatus 1 detects the temperatures and the pieces of humidity in the neighborhood of the intermediate transfer belt 8 at the certain times t1 and t2. The control section 40 calculates the environment change information on the basis of the detected information. The control section 40 judges the existence of the necessity of the correction of the transfer voltage of the primary transfer roller 7 on the basis of the difference between the calculated environment change information (inclination b) and the environment dependence characteristic information (inclination a).

Furthermore, the control section 40 calculates the elapsed time on the basis of the times t1 and t2. Furthermore, the control section 40 determines the constant C of the resistance change characteristic information (formula (2)) on the basis of the detected temperatures and pieces of humidity. The control section 40 calculates the resistance value of the primary transfer roller 7 on the basis of the resistance change characteristic information and the elapsed time. The control section 40 executes the correction of the transfer voltage of the primary transfer roller 7 on the basis of the resistance value.

Consequently, the more proper correction of the process conditions can be performed under the conditions of being in the process of environment changes. To put it concretely, the correction of the process conditions in consideration of the change characteristics of the resistance value of the member that is used for an electrophotographic process and constitutes the image forming apparatus 1 can be performed.

According to a first aspect of the present invention, an image forming apparatus 1 for performing image formation by using an electrophotographic process includes a control section 40 for judging existence of necessity of correction of process conditions in the electrophotographic process based on environment dependence characteristic information (inclination a) of a resistance value of a member that is used for the electrophotographic process and constitutes the image forming apparatus 1 and environment change information in the own apparatus. The control section 40 performs the correction based on a result of the judgment.

Namely, the proper correction of the process conditions in the image forming apparatus 1 can be performed under the conditions of being in the process of environment changes.

Preferably, the image forming apparatus 1 further includes a detection section 50 for detecting a temperature and humidity in the own apparatus, wherein the control section 40 uses ratios of temperatures and pieces of humidity at which the resistance values of the member become comparable levels, the member having been left as it is for a sufficiently long time, as the environment dependence characteristic information, and calculates a ratio between an absolute value of a difference of the temperatures detected by the detection section 50 at a first time (t1) and a second time (t2) and an absolute value of a difference between the pieces of humidity detected by the detection section 50 at the first time and the second time as the environment change information.

Namely, the correction of the more proper process conditions can be performed under the conditions of being in the process of environment changes.

Preferably, the control section 40 calculates a difference value between the environment dependence characteristic information and the environment change information and judges the existence of the necessity of the correction of the process conditions based on the difference value.

Namely, the correction of the more proper process conditions can be performed under the conditions of being in the process of environment changes.

Preferably, the control section 40 uses a characteristic of a change of the resistance value of the member accompanying a change of a surrounding environment as the resistance change characteristic information, calculates correction widths of values of the process conditions based on the resistance change characteristic information, and performs the correction based on the calculated correction widths.

Namely, the correction of the process conditions can be performed in consideration of the environment changes.

Preferably, the image forming apparatus 1 further includes a measurement section (control section 40) for measuring a time, wherein the control section 40 calculates a difference value between the first time (t1) and the second time (t2) measured by the measurement section (control section 40) as an elapsed time, calculates the resistance value of the member based on the elapsed time and the resistance change characteristic information, and calculates the correction widths of the values of the process conditions based on the calculated resistance value.

Namely, the correction of the process conditions can be performed in consideration of the environment changes.

Preferably, the member is a primary transfer roller 7.

Preferably, one of the values of the process conditions is a transfer voltage value.

Namely, proper correction of the process conditions in an electrophotographic process can be performed.

According to a second aspect of the present invention, a computer-readable storage medium (HDD 43) to store a program for causing the computer to function as a control section 40 for judging existence of necessity of correction of process conditions in an electrophotographic process based on environment dependence characteristic information of a resistance value of a member that is used for the electrophotographic process and constitutes an image forming apparatus 1 and environment change information in the image forming apparatus 1, which control section 40 performs the correction based on a result of the judgment.

Namely, the correction of the proper process conditions of the image forming apparatus can be performed under the conditions of being in process of environment changes.

According to a third aspect of the present invention, an image forming method executed by the image forming apparatus 1 includes the steps of: judging existence of necessity of correction of process conditions in the electrophotographic process based on environment dependence characteristic information of a resistance value of a member, which is used for the electrophotographic process and constitutes the image forming apparatus 1, and environment change information in the image forming apparatus 1 (S204); and performing the correction (S209) based on a result of the judgment obtained in the judging step (S204).

Preferably, the image forming method further includes the steps of: detecting a temperature and humidity in the image forming apparatus 1 (S101, S102, S201, S202); calculating a ratio of temperatures and pieces of humidity at which the resistance values of the member become comparable levels, the member having been left as it is for a sufficiently long time, as the environment dependence characteristic information (S103, S203); and calculating a ratio between an absolute value of a difference of the temperatures detected in the detecting step (S101, S102, S201, S202) at a first time and a second time and an absolute value of a difference between the pieces of humidity detected in the detecting step (S101, S102, S201, S202) at the first time and the second time as the environment change information.

Preferably, the judging step (S204) includes, calculating a difference value between the environment dependence characteristic information and the environment change information, and judges the existence of the necessity of the correction of the process conditions based on the calculated difference value.

Preferably, the step for performing the correction (S105, S209) includes: calculating correction widths of values of the process conditions based on resistance change characteristic information, which is obtained by using a characteristic of a change of the resistance value of the member accompanying a change of a surrounding environment as the resistance change characteristic information, and performing the correction based on the calculated correction widths.

Preferably, the calculating step for calculating the correction widths includes the steps of: measuring a time, calculating a difference value between the first time and the second time measured in the measuring step as an elapsed time (S206), calculating the resistance value of the member based on the calculated elapsed time and the resistance change characteristic information (S208), and calculating the correction widths of the values of the process conditions based on the calculated resistance value.

Preferably, the member is a primary transfer roller 7.

Preferably, one of the values of the process conditions is a transfer voltage value. In addition, the description of the respective embodiments described above concerns an example of the image forming apparatus according to the present invention, and the scope of the invention is not limited to the description. The constructional details and the operational details of the image forming apparatus can also suitably be changed.

For example, although the member that is used for an electrophotographic process and constitutes the image forming apparatus 1 is the primary transfer roller 7 in each of the embodiments described above, the member is not limited to the primary transfer roller 7. For example, the member may be the secondary transfer roller 21. In this case, the detection section 50 is installed in the neighborhood of the secondary transfer roller 21. Furthermore, the configuration in which the control section 40 corrects the process conditions pertaining to both of the primary transfer roller 7 and the secondary transfer roller 21 may be adopted.

Furthermore, the examples of using the HDDs 43 as the computer-readable media storing programs have been disclosed in the embodiments, the present invention is not limited to the examples. A portable recording medium, such as a compact disc read-only memory (CD-ROM), a nonvolatile memory, such as a flash memory, and the like can be applied as the other computer-readable media. Furthermore, a carrier wave can also be applied as a medium for providing the data of programs through communication lines.

The present application claims the priority right under the Paris Convention of Japanese Patent Application No. 2009-202216 filed in Japanese Patent Office on Sep. 2, 2009, and the Japanese Patent Application constitutes the basis of the correction of erroneous transformations of the present US patent application.

What is claimed is:

1. An image forming apparatus for performing image formation by using an electrophotographic process, comprising:

a detection section for detecting a temperature and humidity in the own apparatus; and a control section for judging existence of necessity of correction of process conditions in the electrophotographic process based on environment dependence characteristic information of a resistance value of a member that is used for the electrophotographic process and constitutes the image forming apparatus and environment change information in the own apparatus, and for performing correction based on a result of the judgment, wherein the control section uses ratios of temperatures and pieces of humidity at which the resistance values of the member become comparable levels, the member having been left as it is a sufficiently long time, as the environment dependence characteristic information, and calculates a ratio between an absolute value of a difference of the temperatures detected by the detection section at a first time and a second time and an absolute value of a difference between the pieces of humidity detected by the detection section at the first time and the second time as the environment change information.

2. The image forming apparatus according to claim 1, wherein the control section calculates a difference value between the environment dependence characteristic information and the environment change information and judges the existence of the necessity of the correction of the process conditions based on the difference value.

3. The image forming apparatus according to claim 1, wherein the control section uses a characteristic of a change of the resistance value of the member accompanying a change of a surrounding environment as the resistance change characteristic information, calculates correction widths of values of the process conditions based on the resistance change characteristic information, and performs the correction based on the calculated correction widths.

4. The image forming apparatus according to claim 3, further comprising a measurement section for measuring a time, wherein the control section calculates a difference value between the first time and the second time measured by the measurement section as an elapsed time, calculates the resistance value of the member based on the elapsed time and the resistance change characteristic information, and calculates the correction widths of the values of the process conditions based on the calculated resistance value.

5. The image forming apparatus according to claim 1, wherein the member is a primary transfer roller.

6. The image forming apparatus according to claim 1, wherein one of the values of the process conditions is a transfer voltage value.

7. A computer-readable storage medium to store a program for causing the computer to function as a control section for judging existence of necessity of correction of process conditions in an electrophotographic process based on environment dependence characteristic information of a resistance value of a member that is used for the electrophotographic process and constitutes an image forming apparatus and environment change information in the image forming apparatus, the control section performing the correction based on a result of the judgment;

wherein the image forming apparatus further comprising a detection section for detecting a temperature and humidity in the own apparatus; and wherein the control section uses ratios of temperatures and pieces of humidity at which the resistance values of the member become comparable levels, the member having been left as it is for a sufficiently long time, as the environment dependence characteristic information, and calculates a ratio between an absolute value of a difference of the temperatures detected by the detection section at a first time and a second time and an absolute value of a difference between the pieces of humidity detected by the detection section at the first time and the second time as the environment change information.

8. An image forming method executed by an image forming apparatus for performing image formation by using an electrophotographic process, the method comprising:

detecting a temperature and humidity in the image forming apparatus;

judging existence of necessity of correction of process conditions in the electrophotographic process based on environment dependence characteristic information of a resistance value of a member, which is used for the electrophotographic process and constitutes the image forming apparatus, and environment change information in the image forming apparatus;

performing the correction based on a result of the judgment obtained in the judging step;

calculating a ratio of temperatures and pieces of humidity at which the resistance values of the member become comparable levels, the member having been left as it is for a sufficiently long time, as the environment dependence characteristic information; and calculating a ratio between an absolute value of a difference of the temperatures detected in the detecting step at a first time and a second time and an absolute value of a difference between the pieces of humidity detected in the detecting step at the first time and the second time as the environment change information.

9. The image forming method according to claim 8, wherein the judging step includes, calculating a difference value between the environment dependence characteristic information and the environment change information, and judges the existence of the necessity of the correction of the process conditions based on the calculated difference value.

10. The image forming method according to claim 8, wherein the step for performing the correction includes:

calculating correction widths of values of the process conditions based on resistance change characteristic information, which is obtained by using a characteristic of a change of the resistance value of the member accompanying a change of a surrounding environment as the resistance change characteristic information, and performing the correction based on the calculated correction widths.

11. The image forming method according to claim 10, wherein the calculating step for calculating the correction widths including the steps of:

measuring a time, calculating a difference value between the first time and the second time measured in the measuring step as an elapsed time, calculating the resistance value of the member based on the calculated elapsed time and the resistance change characteristic information, and calculating the correction widths of the values of the process conditions based on the calculated resistance value.

12. The image forming method according to claim 8, wherein the member is a primary transfer roller.

13. The image forming method according to claim 8, wherein one of the values of the process conditions is a transfer voltage value.

* * * * *